US009192866B2

(12) United States Patent
Svendsen

(10) Patent No.: US 9,192,866 B2
(45) Date of Patent: Nov. 24, 2015

(54) WATER SLIDE WITH SPRAY FOUNTAIN DELIVERY SYSTEM

(71) Applicant: S. R. Smith, LLC, Canby, OR (US)

(72) Inventor: William J. Svendsen, Aurora, OR (US)

(73) Assignee: S.R. SMITH, LLC, Canby, OR (US)

( * ) Notice: Subject to any disclaimer, the term of this patent is extended or adjusted under 35 U.S.C. 154(b) by 0 days.

(21) Appl. No.: 14/165,418

(22) Filed: Jan. 27, 2014

(65) Prior Publication Data

US 2014/0213379 A1 Jul. 31, 2014

Related U.S. Application Data

(63) Continuation-in-part of application No. 29/444,242, filed on Jan. 28, 2013, now Pat. No. Des. 703,782.

(60) Provisional application No. 61/757,700, filed on Jan. 28, 2013.

(51) Int. Cl.
*A63G 21/18* (2006.01)
*A63G 31/00* (2006.01)

(52) U.S. Cl.
CPC ..... *A63G 21/18* (2013.01)

(58) Field of Classification Search
CPC ..... A63G 21/00; A63G 21/10; A63G 21/18; A63G 31/00; A63G 31/007; A63B 67/007; A63B 2009/008
USPC ..... 472/116, 117, 128, 129, 13
See application file for complete search history.

(56) References Cited

U.S. PATENT DOCUMENTS

| | | | | |
|---|---|---|---|---|
| D218,625 | S | 9/1970 | Abrens | |
| 3,565,226 | A | 2/1971 | Winchester | |
| D221,963 | S | 9/1971 | Henning | |
| D227,382 | S | 6/1973 | Wormser | |
| 3,755,878 | A | 9/1973 | Henning | |
| 3,814,418 | A | 6/1974 | Henning | |
| D250,784 | S | 1/1979 | Dieter et al. | |
| D262,230 | S | 12/1981 | Ament et al. | |
| D268,859 | S | 5/1983 | Ament et al. | |
| 4,805,897 | A * | 2/1989 | Dubeta | 472/117 |
| 4,805,898 | A | 2/1989 | Jacober et al. | |
| 4,893,807 | A | 1/1990 | Ahrens | |
| D335,517 | S | 5/1993 | Vatterot | |
| D344,317 | S | 2/1994 | Petersheim | |
| 5,378,197 | A | 1/1995 | Briggs | |
| D361,614 | S | 8/1995 | Aker et al. | |
| 5,478,281 | A | 12/1995 | Forton | |

(Continued)

OTHER PUBLICATIONS

Brochure: SR Smith, LLC "Pool Slides" (2010), downloaded Jan. 2013 from http://www.srsmith.com (three pages).

(Continued)

*Primary Examiner* — Kien Nguyen
(74) *Attorney, Agent, or Firm* — Stoel Rives LLP

(57) ABSTRACT

A water slide for a recreational pool or other body of water, the water slide being in a spiral configuration with a runway or flume down the spiral and into the pool. The water slide also includes a fountain, which may be centrally located within the spiral slide flume, that produces an upward and outward water spray pattern with an outer envelope that may be sized to correspond to an outer diameter or given outer extent of the spiral slide flume such that the water spray from the fountain falls substantially onto the water slide runway as opposed to on the pool deck.

18 Claims, 7 Drawing Sheets

(56) References Cited

U.S. PATENT DOCUMENTS

| | | | | |
|---|---|---|---|---|
| D372,065 | S | 7/1996 | Gilles | |
| 5,741,189 | A * | 4/1998 | Briggs | 472/128 |
| D418,895 | S | 1/2000 | Ruggiero | |
| D429,788 | S | 8/2000 | Sutton | |
| 6,319,139 | B1 * | 11/2001 | Tracy | 472/128 |
| 6,375,578 | B1 | 4/2002 | Briggs | |
| 6,569,023 | B1 * | 5/2003 | Briggs | 472/117 |
| 6,575,840 | B2 | 6/2003 | Hagerty | |
| 6,786,830 | B2 * | 9/2004 | Briggs et al. | 472/128 |
| D577,408 | S | 9/2008 | Ketcherside et al. | |
| D589,110 | S | 3/2009 | Ketcherside et al. | |
| D594,079 | S | 6/2009 | Ketcherside et al. | |
| D703,782 | S | 4/2014 | Svendsen | |
| D731,018 | S | 6/2015 | Svendsen | |

OTHER PUBLICATIONS

Brochure: SR Smith, LLC "TurboTwister" model pool slide (2012), downloaded Jan. 2013 from http://www.srsmith.com/media/47937/turbotwister0312.pdf (one page).

Brochure: SR Smith, LLC "Vortex™" model pool slide (2012), downloaded Jan. 2013 from www.srsmith.com/products/pool-slides/vortex.aspx (one page).

Brochure: SR Smith, LLC "Typhoon™" model pool slide (2012) downloaded Jan. 2013 from http://www.srsmith.com/media/47943/tvphoon0312.pdf (one page).

Brochure:INTER-FAB "G-Force2Slide" (2008), downloaded Jan. 2014 from http://www.interfab.com/getattachment/7c633152-bd06-4927-b344-88196bbd56d1/G-Force.aspx (one page).

Online Brochure: King's Fibreglass "Swimming Pool Slides" (2012), http://www.kingsfibreglass.com.au/kings_fibreglass_pool_slides.html Visited Dec. 12, 2013 (two pages).

Svendsen, U.S. Appl. No. 29/444,242, filed Jan. 28, 2013, titled Water Slide.

Svendsen, U.S. Appl. No. 29/526,036, filed May 5, 2015, titled "Water Slide".

Pool & Spa News, Dec. 2012 Issue, "2013 New Products Supplement" (eight pages) http://www.poolspanews.com/products/new-products-2013_2.aspx Visited May 26, 2015.

* cited by examiner

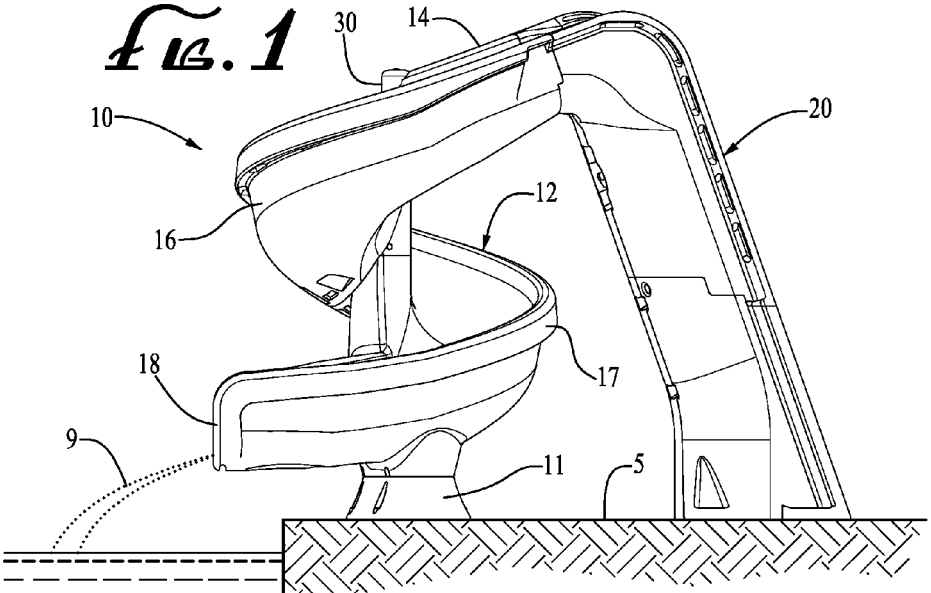
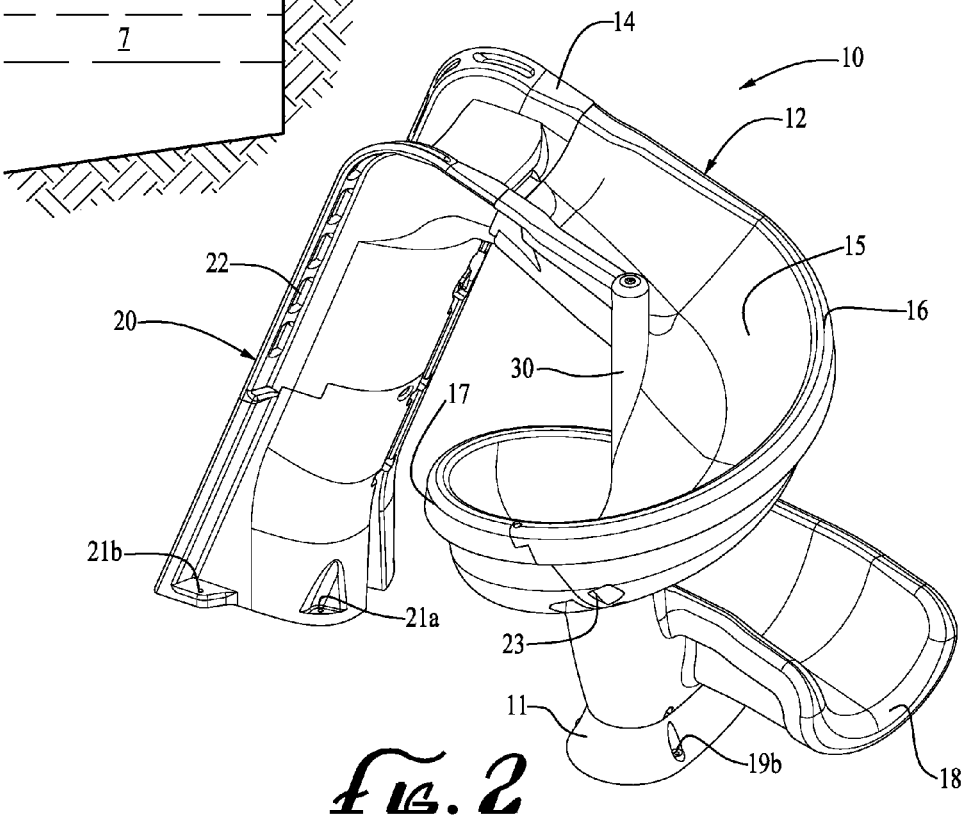
FIG. 2

WATER SLIDE WITH SPRAY FOUNTAIN DELIVERY SYSTEM

RELATED APPLICATION DATA

This application claims priority under 35 U.S.C. 119(e) to provisional application No. 61/757,700 filed Jan. 28, 2013, and is a continuation-in-part of design patent application No. 29/444,242 filed Jan. 28, 2013, each of these applications hereby incorporated by reference.

BACKGROUND

The field of this disclosure relates generally to water slides such as the type where a person slides down the slide and into a swimming area such as a swimming pool as well as water delivery systems and methods for water slide operation.

Various water slides have been devised for use with swimming pools. Typically, the water slide is equipped with a water delivery system at the top of the slide flume, the water delivery system providing a stream of water onto the surface of the flume for lubricating the flume. The water stream flows down the flume and exits into the pool where it may be recirculated back onto the slide via the water recirculation/delivery system.

The present inventor has recognized that certain water slide configurations and water delivery systems do not provide a well-distributed water flow about the width of the slide flume and/or they do not provide any aesthetic attraction of the water flow. The present inventor has therefore determined that it would be desirable to provide a water slide with an improved water delivery system.

BRIEF DESCRIPTION OF THE DRAWINGS

Understanding that drawings depict only certain preferred embodiments and are not therefore to be considered to be limiting in nature, the preferred embodiments will be described and explained with additional specificity and detail through the use of the accompanying drawings.

FIG. 1 is a right side elevation view of a water slide structure according to a according to a first embodiment.

FIG. 2 is a top front left side isometric view of the water slide of FIG. 1.

FIGS. 8-13 are views of an example water slide of the embodiment of FIGS. 1-7 diagrammatically illustrating an example water spray pattern wherein FIG. 8 is a top front left side isometric view; FIG. 9 is a top plan view; FIG. 10 is a top front right side isometric view; FIG. 11 is a left side elevation view; FIG. 12 is a front side elevation view; and FIG. 13 is a right side elevation view.

DETAILED DESCRIPTION OF EMBODIMENTS

Figure 4:
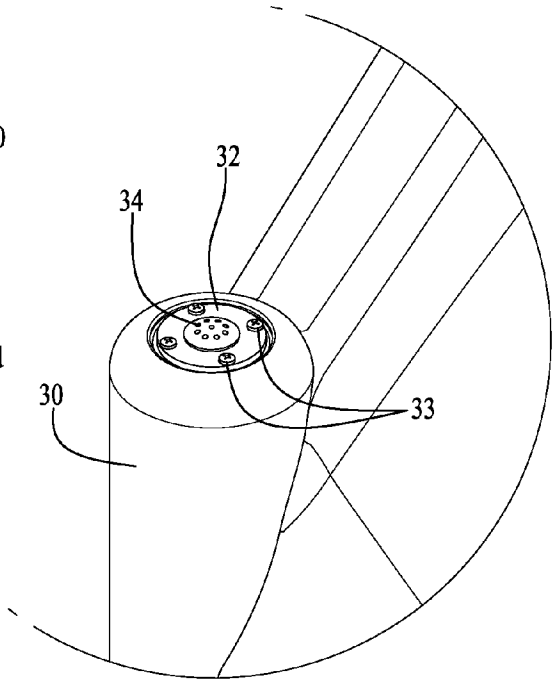
FIG. 4 is a detailed view of a portion of the water slide of FIG. 3 on an enlarged scale.

With reference to the drawings, this section describes particular embodiments and their detailed construction and operation. The embodiments described herein are set forth by way of illustration only and not limitation. The described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. In other instances, well-known structures, materials, or methods of operation are not shown or not described in detail to avoid obscuring more pertinent aspects of the embodiments.

In the following description of the figures and any example embodiments, it should be understood that use of the water slide having the described features in a swimming pool environment is merely one use for such a system and should not be considered as limiting. Other uses for water slides with the characteristics and features described are envisioned.

FIGS. 1-7 illustrate an example water slide 10 according to a first embodiment with FIGS. 8-13 also diagrammatically illustrating an example water spray fountain pattern. FIG. 1 illustrates a right side elevation view of a water slide 10 disposed on a deck surface 5 adjacent a swimming pool 7. The water slide 10 includes (a) a stair/ladder section 20, (b) a downwardly spiral slide flume structure 12, and (c) a base section 11, which also may be referred to as a pedestal, supporting a spiral flume structure 12. The flume structure 12 is comprised of a downwardly descending spiral structure with a top section 14 (connected to the stair/ladder section 20), a first curve section 16, a second curve section 17 and a bottom section 18. The slide 10 is illustrated as a right hand spiral/curve, but may alternately be constructed in a left hand curve configuration. The flume or runway 15 has preferably a smooth surface, including as between the modular sections, so as to provide a smooth ride to the user sliding down the slide.

Figure 3:
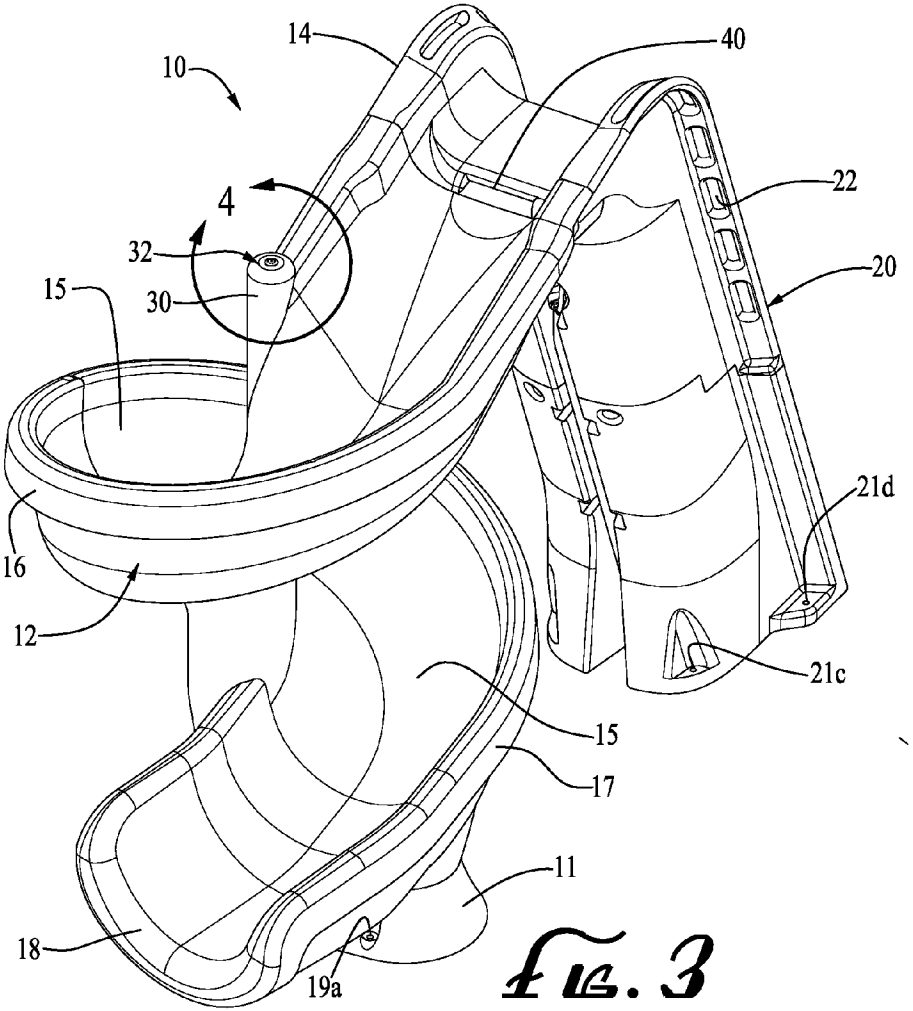
FIG. 3 is a top front right side isometric view of the water slide of FIG. 1.
Figure 7:
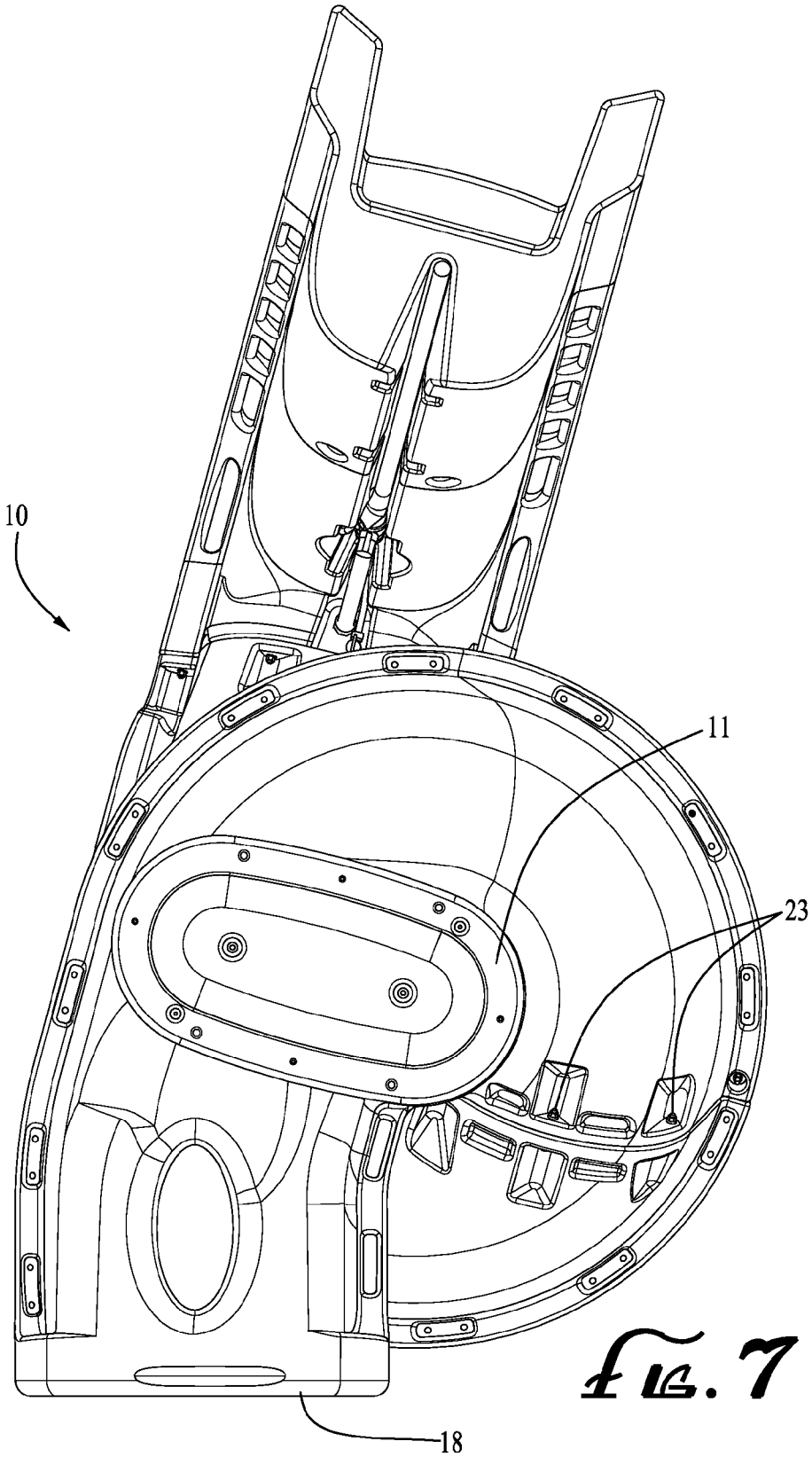
FIG. 7 is a bottom view of the water slide of FIGS. 1-6.
Figure 8:
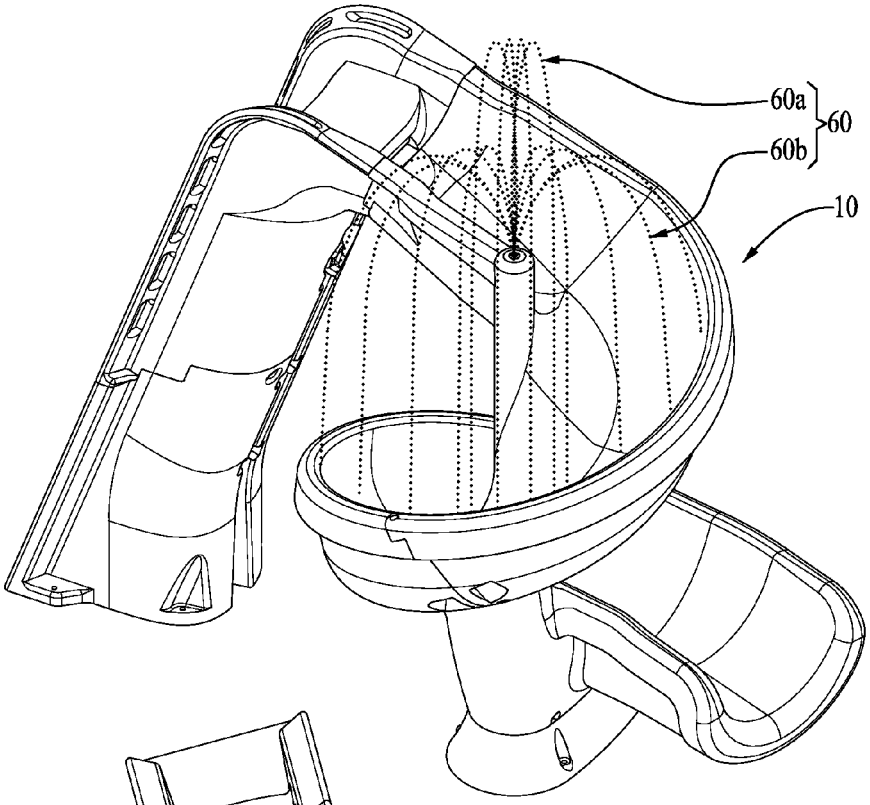
Figure 9:
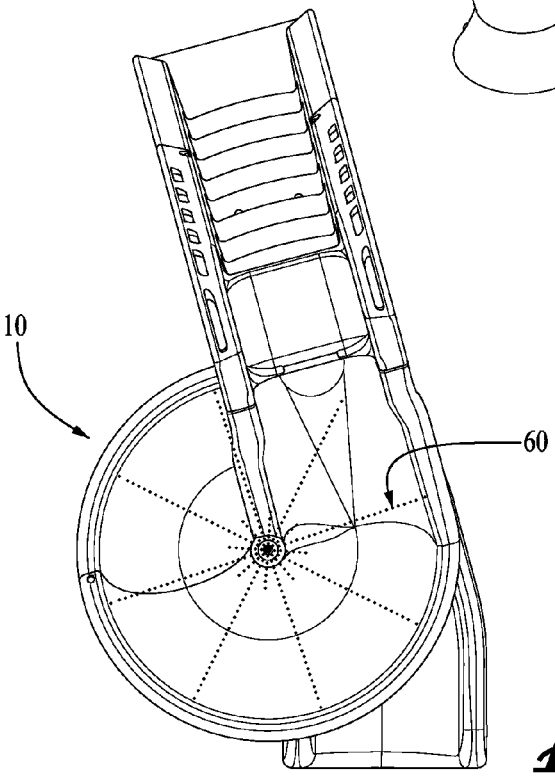
Figure 10:
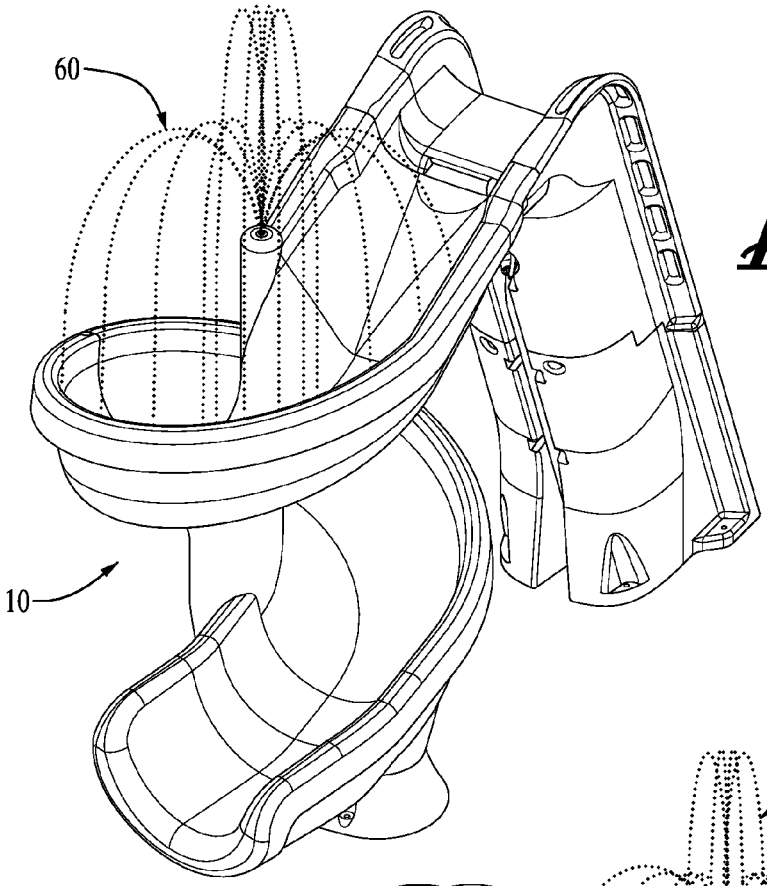
Figure 11:
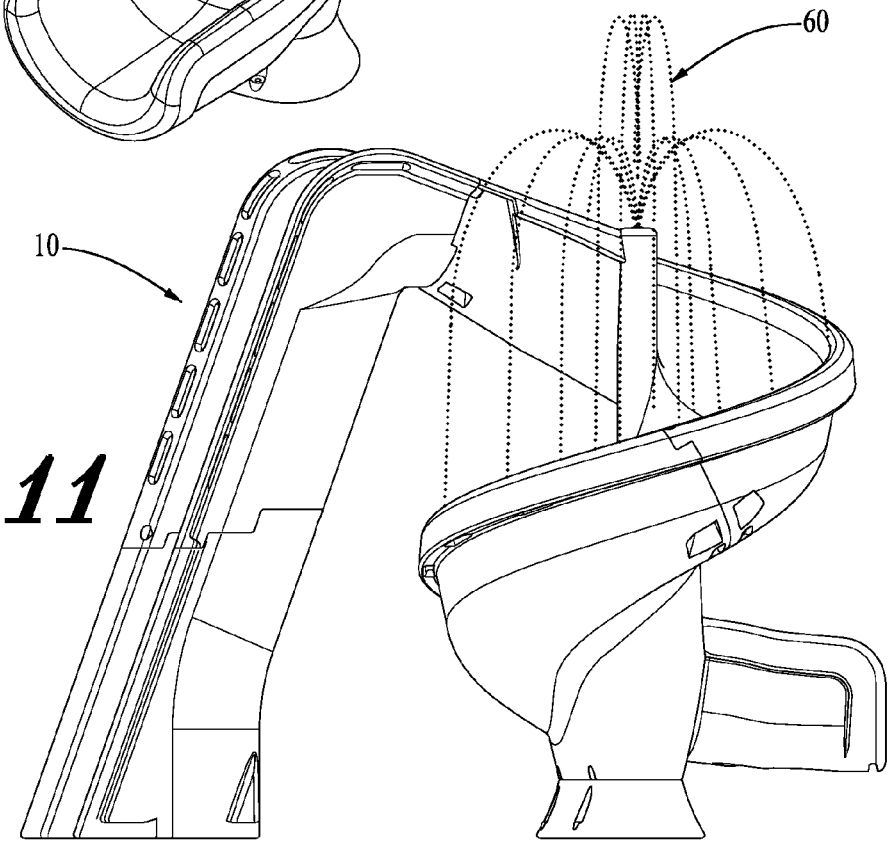
Figure 12:
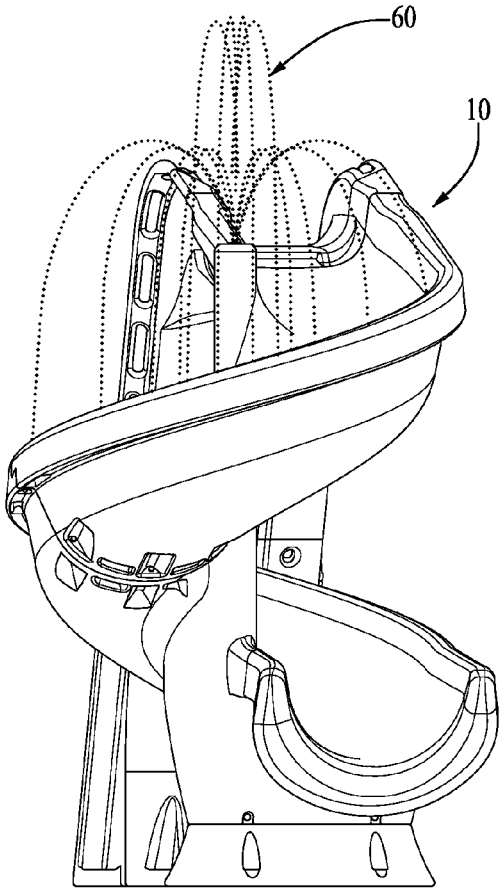
Figure 13:
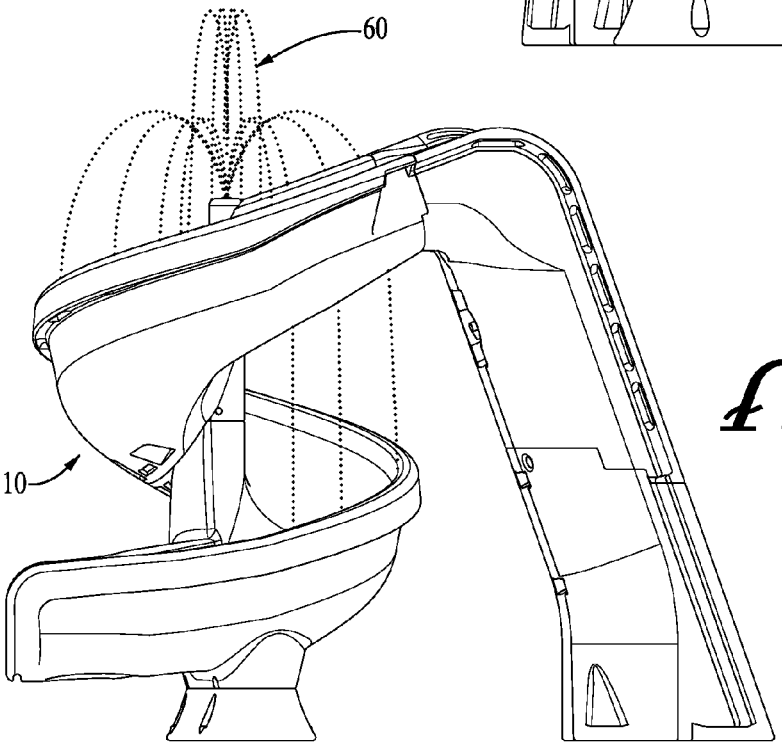

As visible in FIGS. 2 and 3, the spiral flume structure 12 is shown constructed out of a plurality of modular sections which are interconnected. Any suitable assembly method or slide construction may be utilized such as either multiple sections or as a one-piece structure. The bottom view of the slide 10 in FIG. 7 illustrates a connector 23 for securing first section 16 to second curved section 17 (the connector 23 is also shown in FIG. 2). The multiple modular sections enable unit breakdown, with reduced size/volume, that may facilitate transportation and shipping. Similarly, the stair/ladder section 20 is also shown as being formed with modular upper and lower sections interconnected for enabling assembly. The slide sections 14-18 may be constructed from thick, durable, roto-molded polyethylene or other suitable material.

The water slide 10 is shown with an open flume 15 (i.e., uncovered) configuration, the open structure having certain advantages as will be evident below. Alternately, portions of the flume structure 12 may be enclosed, such as at the exit section 18.

The stair/ladder section 20 may also be constructed of molded polyethylene or other suitable material. The stair section 20 is illustrated as having eight enclosed steps (see FIG. 9), enclosed meaning that the back side is enclosed rather than open as would be a ladder configuration. The surface of the stairs may include drainage openings or perforations, the openings being large enough to allow water drainage but small enough such the foot or other extremity of a child cannot pass through. The lateral side handrails 22 are molded into the stair/ladder section 20.

The stair/ladder section 20 is secured to the deck 5 by four stainless steel studs 21*a*, 21*b*, 21*c*, 21*d* shown in FIGS. 2-3. Similarly the pedestal/base 11 is secured to the deck 5 via four stainless steel studs arranged about the pedestal perimeter, wherein studs 19*a*, 19*b* are visible in FIGS. 2-3. Other suitable connection/securement mechanisms may be employed.

Following is a description of the water distribution system. Water is pumped into the main water jet 40 (water injector) for dispersion and flow down the flume 15 and exiting at the end section 18 in a stream 9 deposited into the pool 7. Water from the water jet 40 is used to lubricate the surface of the slide flume 15 to allow for easy sliding down the slide by the user.

The structure of the water slide 10 includes a fountain structure or element 30 centrally located within spiral flume 15, the fountain element 30 being generally disposed along a central axis of the spiral slide structure 12. Alternately, the spiral slide section 12 may be described as being disposed or wrapped around the fountain element 30. The structure of fountain element 30, shown in more detail in FIGS. 3-4, is illustrated as a column or stanchion of a generally round cylindrical shape, but it may comprise alternate configurations or shapes. Alternately, the fountain element or stanchion 30 may be described as being positioned at a central axis of the spiral flume 15. The height of the fountain element 30 is illustrated as terminating generally flush with top side wall of the flume section 16 adjacent thereto, but alternately may extend upwardly to a higher vertical position. The fountain element 30 may be described as a stanchion that (optionally) provides structural support for the fountain components. That same stanchion structure may (or may not) also provide structural support for the flume of the spiral slide structure 12, whereby alternately the spiral slide structure 12 itself may provide support for both the flume and the stanchion 30.

Toward the top of the structure 30 is located a spray nozzle or sprayer element/system providing a desired fountain spray pattern. In the example illustrated, the fountain element 30 has a top plate 32 positioned on a top surface of the fountain element 30, the plate 32 secured by screws 33 or other suitable mechanism. The top plate 32 is formed with or includes a nozzle or spray-fitting 34 which is selected to provide the desired fountain spray pattern. The top plate 32 and/or nozzle 34 may be removable to enable change-out for replacement/repair or to allow installation of an alternate nozzle for producing another spray pattern.

Figure 6:
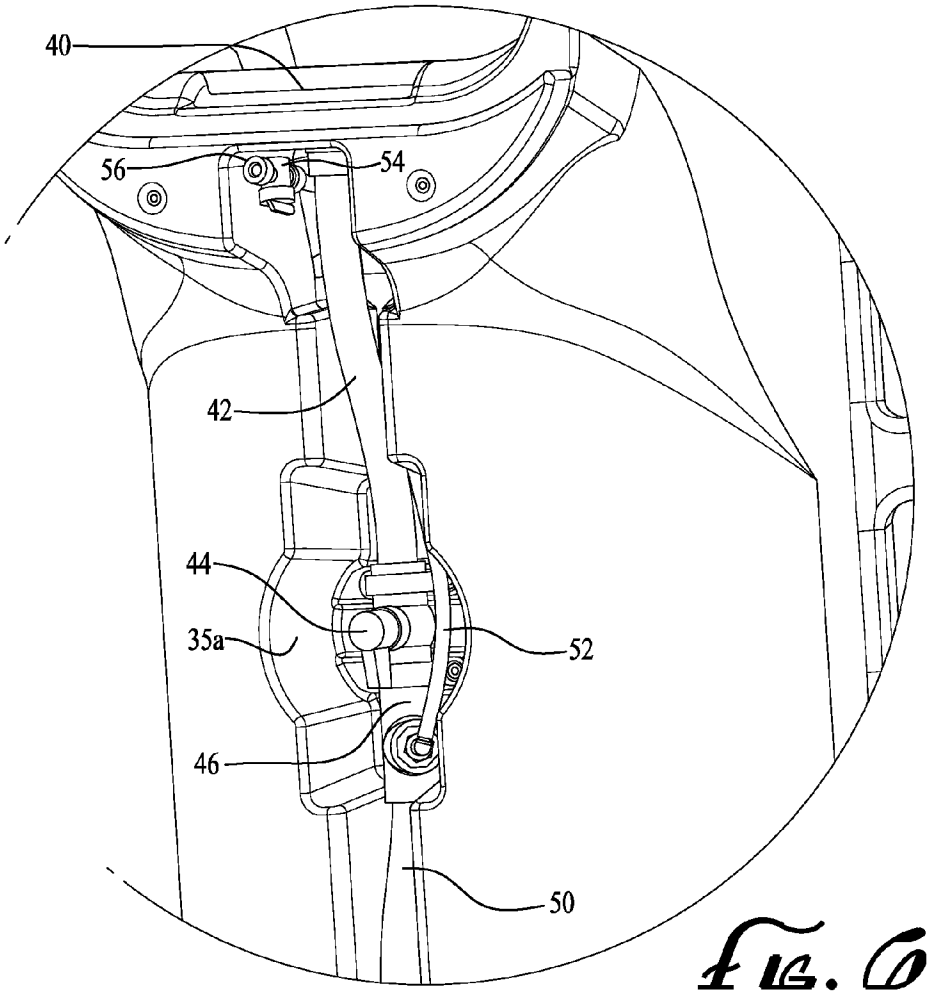
FIG. 6 is a detailed view of a portion of the ladder/stair section of FIG. 5 on an enlarged scale.
Figure 5:
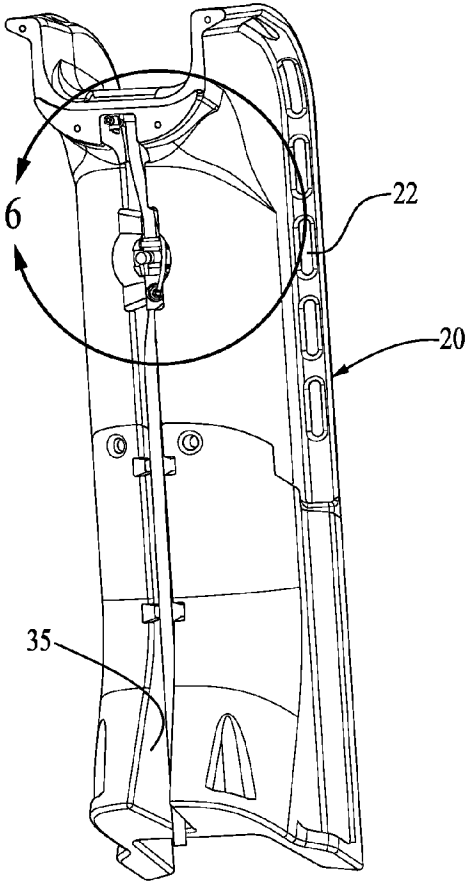
FIG. 5 is a front bottom right side isometric view of the ladder/stair section of the water slide of FIGS. 1-4.

FIGS. 5-6 illustrate details of the water delivery system for the main water jet 40 and the fountain 30. FIG. 5 illustrates the stair/ladder section 20 removed from the remaining structure. The inside portion of the ladder section 20 includes a longitudinal channel 35 running its length within which the water supply components are housed. Turning to the detail in FIG. 6, water from a main water supply conduit or water line 50 travels through main line valve 44 and connector pipe 42. Flow of water to the water jet 40 is controlled by a throttle valve 44. The throttle valve 44 is disposed within channel section 35*a*, which is an enlarged portion of the channel 35. A tee fitting 46 is disposed upstream of the valve 44. A tee fitting 46 provides water supply to fountain line 52 which is routed to a separate fountain valve 54 whose outlet 56 is routed by a second fountain line section to the fountain nozzle 34 for delivering water and producing the desired spray pattern. Other valve and water supply conduit configurations may be employed.

The inlet line 50 and connector pipe 42 may be constructed of 1 inch (2.5 cm) PVC flex hose or other pipe/tubing of suitable material and/or size. The fountain line may be constructed of ½ inch PVC flex hose or other suitable material and/or size.

As previously described, the nozzle 34 may be selected and constructed and arranged to produce any suitable fountain spray pattern. The flow of water provides not only an aesthetic/decorative function, but also a useful function as being centrally located within the spiral of the water slide, the water spray falls onto the flume 15 and provides additional surface lubrication. As shown in these figures and particularly the top view of FIG. 9, the downwardly spiral shape of the slide 10 forms a circular outer radial extent or envelope with portions of the slides being at different vertical levels. By forming the spray pattern 60 also in a generally circular pattern, the outer envelope of the spray pattern 60, as viewed from the top view, may be sized to coincide with or fall or be dispersed within the general diameter of the outer extent of the spiral slide such that all of (or most of) the water from the fountain spray falls or is dispersed onto the flume 15 of the slide and thus does not generally land outside of the flume and onto the surface of the deck. Thus by centrally locating the fountain feature within the center (e.g., at the central axis) of a spiral slide design, the water fountain can provide: (1) an attractive aesthetic feature, (2) a fun feature through which the user of the slide passes through as he/she proceeds down the slide, (3) a spiral slide configuration that catches all of the water (or may catch substantially most of the water) so that water is not sprayed onto the deck, and (4) additional or alternate lubrication for the slide.

Use of the control valves as previously described may allow the fountain to be turned off or turned on as desired. Moreover, the water jet 40 may be turned off and only the fountain spray operated. The control combination of main valve 44 and fountain valve 54 can provide control of desired amount of water flow to each of the main water jet 40 and the fountain nozzle 34. For example, control options may include (1) the main valve 44 may be closed and the fountain control valve 54 opened such that water flow onto the slide flume is solely from the fountain nozzle 34; (2) the main valve 44 may be opened and the fountain valve 54 closed such that water flow is solely out of the water jet 40; (3) the main valve 44 and the fountain valve 54 may both be opened such that water flow is provided both from the water jet 40 and the fountain nozzle 34 (the relative amounts of the respective water flows adjusted by throttling of the respective control valves 44, 54). Due in part to its central location, water from the fountain 30 may be sufficient to provide all of the necessary lubrication for slide usage.

The water pattern 60 illustrated in FIGS. 8-13 includes an upper spray portion 60*a* and a lower spray portion 60*b*. Either the upper spray portion 60*a* or the lower spray portion 60*b* may be omitted resulting in alternate spray patterns. Each of the upper spray portion 60*a* and the lower spray portion 60*b* comprises a decorative spray pattern with an outer envelope that falls onto the slide flume within the outer extent of the flume, and wherein the water of the spray portion falls onto the slide flume at differing vertical levels.

Other embodiments are envisioned. Various different spray pattern designs may employed, such as the various alternate designs disclosed in the present inventor's U.S. Design application No. 29/444,242 entitled WATER SLIDE filed Jan. 28, 2013, hereby incorporated by reference. Solenoid valves may be installed to allow alternate control schemes, including varying spray pattern incrementally or continuously, or changing the designs of the spray pattern for either aesthetic or other reasons.

Although the description above contains certain specific details, these details should not be construed as limiting the scope of the invention, but as merely providing illustrations of some embodiments/examples. It should be understood that subject matter disclosed in one portion herein can be combined with the subject matter of one or more of other portions herein as long as such combinations are not mutually exclusive or inoperable.

The terms and descriptions used herein are set forth by way of illustration only and not meant as limitations. It will be obvious to those having skill in the art that many changes may be made to the details of the above-described embodiments without departing from the underlying principles of the invention(s).

The invention claimed is:

1. A water slide comprising a central fountain stanchion;

a downwardly spiral slide flume disposed about the stanchion and having a given outer extent;

a water spray nozzle disposed at a top portion of the central fountain stanchion;

a water supply conduit operative for supplying water to the water spray nozzle, wherein the water spray nozzle is operative for producing a spray pattern with an outer envelope that falls onto the slide flume within the given outer extent.

2. A water slide according to claim 1 wherein the spiral slide flume is formed with a generally circular outer extent about a central axis, and wherein the central fountain stanchion is disposed along the central axis of the spiral slide flume.

3. A water slide according to claim 1 wherein the water is directed upwardly and outwardly from the water spray nozzle for forming the spray pattern.

4. A water slide according to claim 1 wherein the spray pattern comprises a form of a generally circular outer envelope.

5. A water slide according to claim 1 wherein the water from the water spray nozzle that forms the spray pattern falls onto the slide flume at differing vertical levels.

6. A water slide according to claim 1 further comprising a water injector disposed at a top section of the slide flume, the water injector being connected to the water supply line and supplying a flow of water onto the slide flume.

7. A water slide according to claim 6 further comprising a main control valve operable for controlling flow of water to the water injector;

a fountain control valve operable for controlling flow of water to the water spray nozzle.

8. For a water slide having a downwardly spiral flume with a given outer extent, a water delivery method comprising:

receiving water from a water supply source;

dispersing the water from the water supply source in an upwardly and outwardly fountain spray of a decorative pattern with an outer envelope falling onto the slide flume within the given outer extent; and forming the fountain spray by directing the water upwardly and outwardly from a spray nozzle centrally located along an axis of the spiral flume.

9. A method according to claim 8 further comprising generating the spray pattern in a form of a generally circular outer envelope.

10. A method according to claim 8 further comprising directing water from the fountain spray to fall onto the spiral flume at differing vertical levels.

11. A water slide comprising a downwardly spiral slide flume having a generally circular outer extent;

a fountain element including a water spray nozzle centrally disposed within the spiral slide flume;

a water supply conduit operative for supplying water to the water spray nozzle, wherein the water spray nozzle is operative for producing a decorative spray pattern with an outer envelope that falls onto the slide flume within the outer extent.

12. A water slide according to claim 11 wherein the water of the decorative spray pattern falls onto the slide flume at differing vertical levels.

13. A water slide according to claim 11 wherein the spiral slide flume is formed with its generally circular outer extent about a central axis, and wherein the fountain element is disposed along the central axis of the spiral slide flume.

14. A water slide according to claim 11 wherein the water is directed upwardly and outwardly from the water spray nozzle for forming the decorative spray pattern.

15. A water slide according to claim 11 wherein the spray pattern comprises a decorative form of a generally circular outer envelope.

16. A water slide according to claim 11 wherein the slide flume is disposed about and wrapped around the fountain element.

17. A water slide according to claim 11 further comprising a water injector disposed at a top section of the spiral slide flume, the water injector being connected to the water supply line and supplying a flow of water onto the slide flume.

18. A water slide according to claim 17 further comprising a main control valve operable for controlling flow of water to the water injector;

a fountain control valve operable for controlling flow of water to the water spray nozzle.

* * * * *